US011101585B1

(12) United States Patent
Omodachi et al.

(10) Patent No.: US 11,101,585 B1
(45) Date of Patent: Aug. 24, 2021

(54) ELECTRICAL CONNECTOR ASSEMBLY WITH PITCH SURFACES ON THE PLUG AND RECEPTACLE

(71) Applicant: Japan Aviation Electronics Industry, Ltd., Tokyo (JP)

(72) Inventors: Takashi Omodachi, Tokyo (JP); Daisuke Machihara, Irvine, CA (US)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 16/911,959

(22) Filed: Jun. 25, 2020

Related U.S. Application Data

(60) Provisional application No. 62/970,260, filed on Feb. 5, 2020.

(51) Int. Cl.

| | |
|---|---|
| ***H01R 12/71*** | (2011.01) |
| ***H01R 12/57*** | (2011.01) |
| ***H01R 13/04*** | (2006.01) |
| ***H01R 13/502*** | (2006.01) |
| ***H01R 13/629*** | (2006.01) |
| ***H01R 12/70*** | (2011.01) |
| *H01R 12/52* | (2011.01) |
| *H01R 12/79* | (2011.01) |

(52) U.S. Cl.
CPC ..... *H01R 12/716* (2013.01); *H01R 12/57* (2013.01); *H01R 12/7005* (2013.01); *H01R 13/04* (2013.01); *H01R 13/502* (2013.01); *H01R 13/629* (2013.01); *H01R 12/52* (2013.01); *H01R 12/79* (2013.01)

(58) Field of Classification Search
CPC .. H01R 12/716; H01R 13/502; H01R 13/629; H01R 12/57; H01R 12/7005; H01R 13/04; H01R 12/52; H01R 12/79
USPC ..... 439/74, 570
See application file for complete search history.

(56) References Cited

U.S. PATENT DOCUMENTS

| | | | | |
|---|---|---|---|---|
| 2015/0270641 | A1 | 9/2015 | Omodachi et al. | |
| 2020/0106200 | A1* | 4/2020 | Ishida | H01R 13/20 |

FOREIGN PATENT DOCUMENTS

| | | | |
|---|---|---|---|
| JP | H1174024 | A | 3/1999 |
| JP | 2002352906 | A | 12/2002 |
| JP | 2015185541 | A | 10/2015 |
| JP | 2015220005 | A | 12/2015 |
| JP | 2016146292 | A | 8/2016 |
| JP | 2019133798 | A | 8/2019 |

* cited by examiner

*Primary Examiner* — Abdullah A Riyami
*Assistant Examiner* — Justin M Kratt
(74) *Attorney, Agent, or Firm* — Renner, Otto, Boisselle & Sklar, LLP

(57) ABSTRACT

A first receptacle pitch inner surface and a first plug pitch outer surface opposite each other are both flat surfaces, and they are configured to come into surface contact with each other in the mated state. A distance in the pitch direction between a second receptacle pitch inner surface and a second plug pitch outer surface opposite each other in the mated state is larger than a distance in the pitch direction between the first receptacle pitch inner surface and the first plug pitch outer surface opposite each other in the mated state. A distance in the pitch direction between the first receptacle pitch inner surfaces of two receptacle pitch inner surfaces is longer than a distance in the pitch direction between the first plug pitch outer surfaces of two plug pitch outer surfaces.

7 Claims, 12 Drawing Sheets

PITCH DIRECTION

INSERTION AND REMOVAL DIRECTION

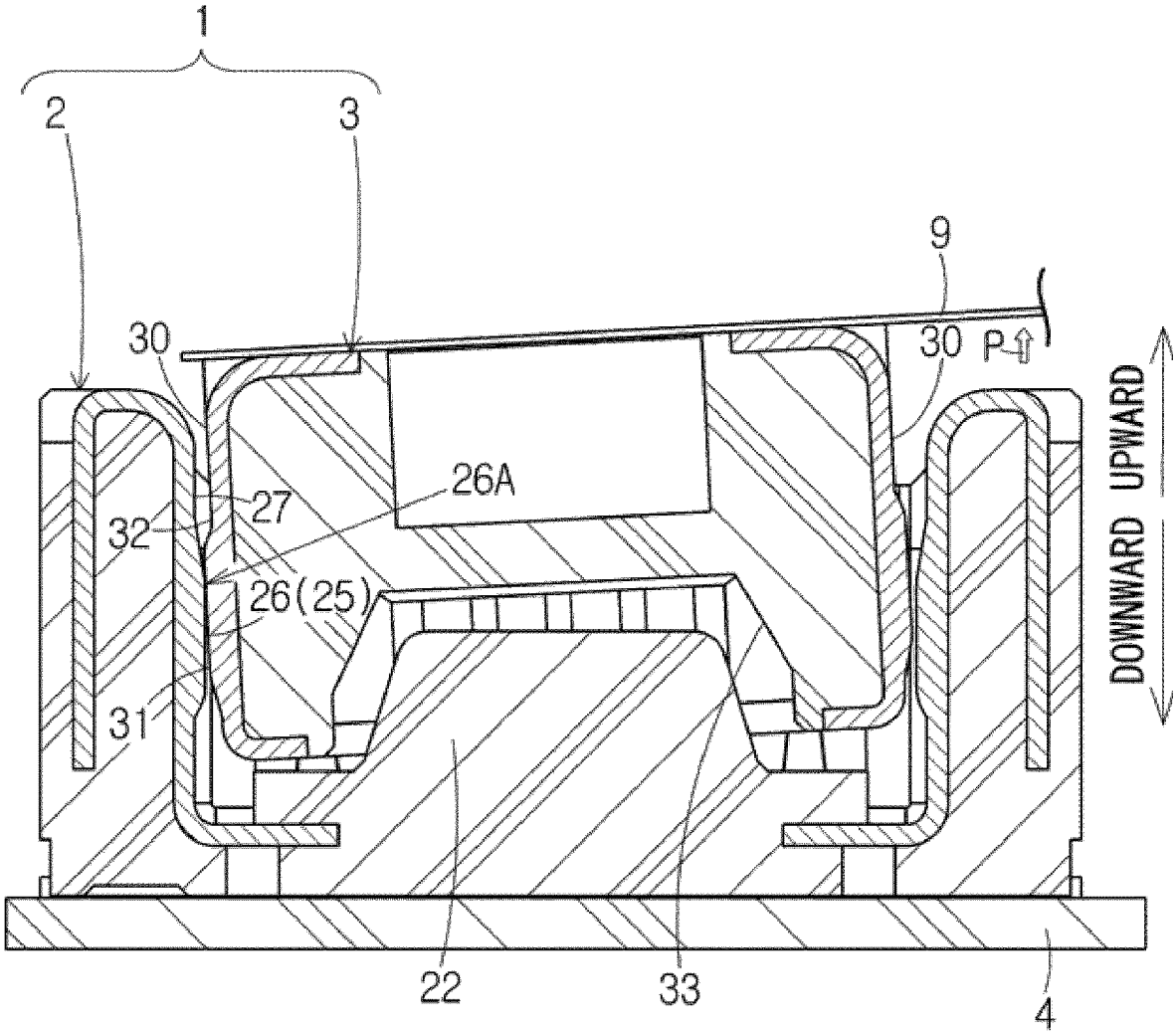
Fig. 10
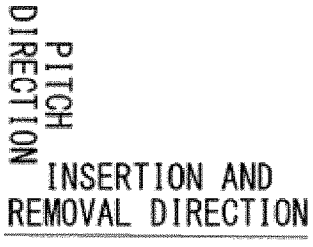

PITCH DIRECTION

INSERTION AND REMOVAL DIRECTION

ELECTRICAL CONNECTOR ASSEMBLY WITH PITCH SURFACES ON THE PLUG AND RECEPTACLE

INCORPORATION BY REFERENCE

This application is based upon and claims the benefit of priority from U.S. Provisional Application 62/970,260, filed on Feb. 5, 2020, the disclosure of which is incorporated herein in its entirety by reference.

BACKGROUND

The present disclosure relates to a connector assembly.

Japanese Unexamined Patent Application Publication No. 2019-133798 discloses a board-to-board connector assembly 104 that includes a receptacle connector 101 to be mounted on a wiring board 100, and a plug connector 103 to be mounted on a wiring board 102, where the receptacle connector 101 and the plug connector 103 are mated with each other to electrically connect the wiring board 100 and the wiring board 102, as shown in FIG. 12 of the present application.

The receptacle connector 101 has a guide part 105 and a guide part 106 that extend in the mated direction and guide the insertion and removal of the receptacle connector 101 to and from the plug connector 103. The plug connector 103 has a fixing bracket 107 to be placed between the guide part 105 and the guide part 106 in the state where the receptacle connector 101 and the plug connector 103 are mated with each other. The guide part 105 and the guide part 106 are formed to guide the removal of the fixing bracket 107 with a tilt toward the guide part 106 in the state where the receptacle connector 101 and the plug connector 103 are mated with each other.

SUMMARY

In the structure disclosed in Japanese Unexamined Patent Application Publication No. 2019-133798 described above, it is not possible to remove the fixing bracket 107 with a tilt toward the guide part 105.

An object of the present disclosure is to improve a connector assembly where a plug connector is removed from a receptacle connector with the plug connector tilted obliquely relative to the receptacle connector.

According to an aspect of the present disclosure, there is provided a connector assembly including a plug connector including a plurality of plug contacts, and a plug main body that accommodates the plurality of plug contacts, and being mountable on a plug side board, and a receptacle connector including a plurality of receptacle contacts, and a receptacle main body that accommodates the plurality of receptacle contacts, and being mountable on a receptacle side board, wherein the plurality of plug contacts and the plurality of receptacle contacts are respectively brought into electrical contact with each other by mating the plug connector and the receptacle connector with each other, the receptacle main body includes a rectangular tube part that accommodates the plug connector in a mated state where the plug connector and the receptacle connector are mated with each other, the rectangular tube part has two receptacle pitch inner surfaces opposite each other in a pitch direction along which the plurality of receptacle contacts are aligned, the plug main body has two plug pitch outer surfaces respectively opposite the two receptacle pitch inner surfaces in the pitch direction in the mated state, each of the receptacle pitch inner surfaces includes a first receptacle pitch inner surface and a second receptacle pitch inner surface in this recited order in a removal direction of removing the plug connector from the receptacle connector, each of the plug pitch outer surfaces includes a first plug pitch outer surface opposite the first receptacle pitch inner surface in the pitch direction in the mated state and a second plug pitch outer surface opposite the second receptacle pitch inner surface in the pitch direction in the mated state in this recited order in the removal direction, the first receptacle pitch inner surface and the first plug pitch outer surface opposite each other are both flat surfaces and configured to come into surface contact with each other in the mated state, a distance in the pitch direction between the second receptacle pitch inner surface and the second plug pitch outer surface opposite each other in the mated state is larger than a distance in the pitch direction between the first receptacle pitch inner surface and the first plug pitch outer surface opposite each other in the mated state, and a dimension in the pitch direction between the first receptacle pitch inner surfaces of the two receptacle pitch inner surfaces is larger than a dimension in the pitch direction between the first plug pitch outer surfaces of the two plug pitch outer surfaces.

It is preferred that a receptacle projecting part that projects in the pitch direction is formed on at least one of the two receptacle pitch inner surfaces, and the first receptacle pitch inner surface is formed on the receptacle projecting part.

It is preferred that a plug projecting part that projects in the pitch direction is formed on at least one of the two plug pitch outer surfaces, and the first plug pitch outer surface is formed on the plug projecting part.

It is preferred that the receptacle main body includes a receptacle housing that is made of resin and holds the plurality of receptacle contacts, and a receptacle supplementary fitting that is attached to the receptacle housing, and the receptacle supplementary fitting has at least one of the two receptacle pitch inner surfaces.

It is preferred that the plug main body includes a plug housing that is made of resin and holds the plurality of plug contacts, and a plug supplementary fitting that is attached to the plug housing, and the plug supplementary fitting has at least one of the two plug pitch outer surfaces.

It is preferred that the rectangular tube part has two short side walls opposite each other in the pitch direction and two long side walls opposite each other in a direction orthogonal to the pitch direction, and the two long side walls are lower than the two short side walls.

It is preferred that the receptacle main body includes an island part that projects in the removal direction, the plug main body has an island part accommodation recess that accommodates the island part in the mated state, and the island part is lower than the two long side walls.

According to the present disclosure, a connector assembly improved with regard to oblique removal is provided.

The above and other objects, features and advantages of the present disclosure will become more fully understood from the detailed description given hereinbelow and the accompanying drawings which are given by way of illustration only, and thus are not to be considered as limiting the present disclosure.

BRIEF DESCRIPTION OF DRAWINGS

FIG. 10 is a side cross-sectional view showing an early stage of obliquely removing the plug connector from the receptacle connector;

DESCRIPTION OF EMBODIMENTS

An embodiment of the present disclosure is described hereinafter with reference to FIGS. 1 to 11.

Figure 1:
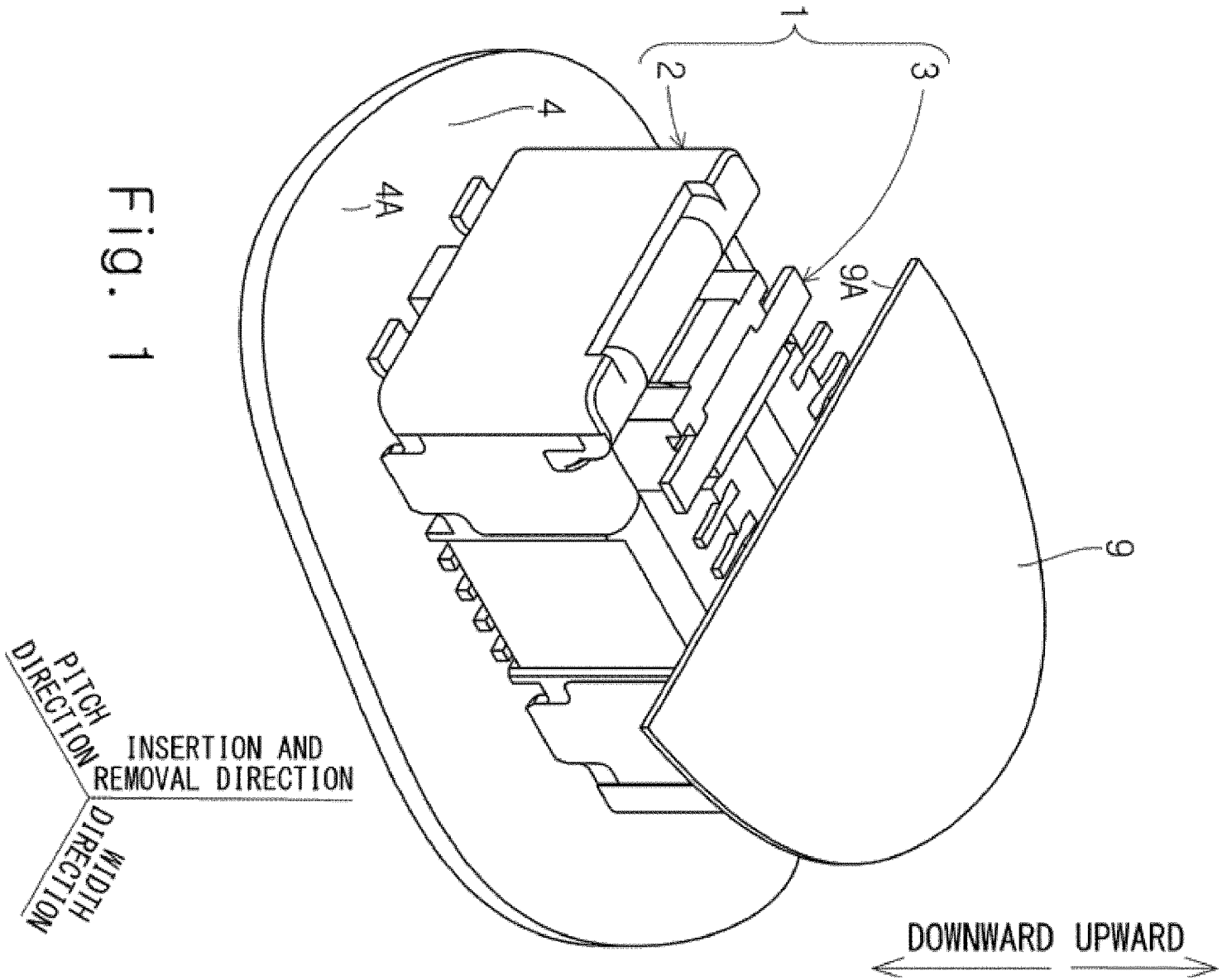
FIG. 1 is a perspective view of a board-to-board connector assembly mated together.
Figure 2:
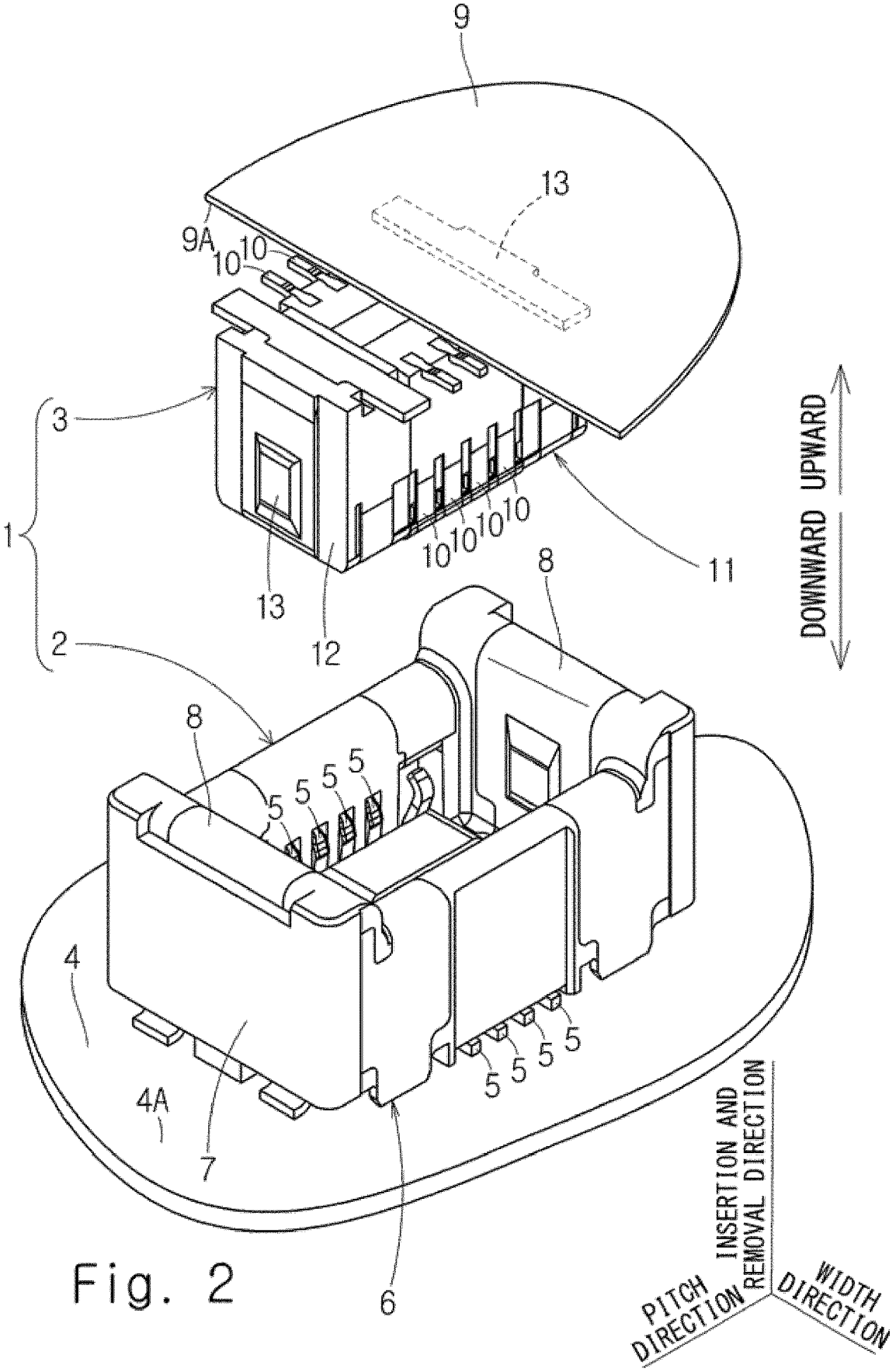
FIG. 2 is a perspective view of the board-to-board connector assembly before being mated together.

FIGS. 1 and 2 show a board-to-board connector assembly 1 (connector assembly). The board-to-board connector assembly 1 includes a receptacle connector 2 and a plug connector 3.

As shown in FIG. 2, the receptacle connector 2 is a connector that is mountable on a connector mounting surface 4A of a receptacle side board 4, and it includes a plurality of receptacle contacts 5 and a receptacle main body 6 that accommodates the plurality of receptacle contacts 5. The receptacle main body 6 includes a receptacle housing 7 and two receptacle supplementary fittings 8.

Each of the plurality of receptacle contacts 5 is formed by punching and bending a plate made of metal. The plurality of receptacle contacts 5 are arranged in two rows. The plurality of receptacle contacts 5 may be arranged in one row. The receptacle housing 7 is made of insulating resin, and it holds the plurality of receptacle contacts 5. The two receptacle supplementary fittings 8 are formed by punching and bending a plate made of metal, and fix the receptacle housing 7 to the connector mounting surface 4A of the receptacle side board 4.

The plug connector 3 is a connector that is mountable on a connector mounting surface 9A of a plug side board 9, and it includes a plurality of plug contacts 10 and a plug main body 11 that accommodates the plurality of plug contacts 10. The plug main body 11 includes a plug housing 12 and two plug supplementary fittings 13.

Each of the plurality of plug contacts 10 is formed by punching and bending a plate made of metal. The plurality of plug contacts 10 are arranged in two rows. The plurality of plug contacts 10 may be arranged in one row. The plug housing 12 is made of insulating resin, and it holds the plurality of plug contacts 10. The two plug supplementary fittings 13 are formed by punching and bending a plate made of metal, and fix the plug housing 12 to the connector mounting surface 9A of the plug side board 9.

In this embodiment, the receptacle side board 4 is a rigid board such as a paper phenolic board or a glass epoxy board, for example, and the plug side board 9 is a flexible board. Alternatively, both of the receptacle side board 4 and the plug side board 9 may be rigid boards or flexible boards. Further, the receptacle side board 4 may be a flexible board, and the plug side board 9 may be a rigid board.

By inserting the plug connector 3 into the receptacle connector 2, the receptacle connector 2 and the plug connector 3 are mated with each other. By mating the receptacle connector 2 and the plug connector 3 with each other, the plurality of receptacle contacts 5 and the plurality of plug contacts 10 come into one-on-one contact.

An insertion and removal direction, a pitch direction and a width direction are defined by referring to FIG. 2. The insertion and removal direction, the pitch direction and the width direction are directions that are orthogonal to one another.

The insertion and removal direction is the direction of inserting and removing the plug connector 3 to and from the receptacle connector 2. The insertion and removal direction includes an insertion direction and a removal direction. The insertion direction is the direction of inserting the plug connector 3 to the receptacle connector 2. The removal direction is the direction opposite to the insertion direction, and it is the direction of removing the plug connector 3 from the receptacle connector 2. The insertion direction is referred to also as downward. The removal direction is referred to also as upward. Upward and downward are terms used by way of illustration only and should not be interpreted as limiting the posture of the board-to-board connector assembly 1 when it is actually used. The insertion and removal direction is also referred to as a height direction.

The pitch direction is the direction along which the plurality of receptacle contacts 5 belonging to one row of the plurality of receptacle contacts 5 arranged in two rows are aligned. The pitch direction includes a pitch inward direction and a pitch outward direction. The pitch inward direction is the direction toward the center of the receptacle contacts 5 in the pitch direction. The pitch outward direction is the direction opposite to the pitch inward direction, and it is the direction away from the center of the receptacle contacts 5 in the pitch direction.

The width direction is the direction orthogonal to the insertion and removal direction and the pitch direction, and it is the direction along which two rows of the plurality of receptacle contacts 5 opposite each other. The width direction includes a width inward direction and a width outward direction. The width inward direction is the direction toward the center of the receptacle contacts 5 in the width direction. The width outward direction is the direction away from the center of the receptacle contacts 5 in the width direction.

In portable electronic equipment such as smartphones, for example, a low-profile board-to-board connector assembly with a height of about 0.5 to 1.0 mm in the mated state, for example, is preferred for use. On the other hand, a high-profile board-to-board connector assembly with a height of about 2.5 mm in the mated state is used in some cases in order to clearly realize mating of a plug connector with a receptacle connector. The high-profile board-to-board connector assembly is considered to provide more clear realization that the plug connector and the receptacle connector are mated with each other because the distance that the plug connector moves inside the receptacle connector in the insertion and removal direction in the state where the plug connector is restrained by the receptacle connector in the pitch direction and the width direction is long. However, in the high-profile board-to-board connector assembly, there is a possibility that the plug connector or the receptacle connector is damaged when obliquely removing the plug connector from the receptacle connector. Oblique removal means removing the plug connector from the receptacle connector with a tilt of the plug connector relative to the receptacle connector. In this manner, a high-profile board-to-board connector assembly and oblique removal are in trade-off with each other. In view of the foregoing, the inventors of the present disclosure have conducted intensive studies and invented a technique of achieving both a high-profile board-to-board connector assembly and oblique removal. The board-to-board connector assembly 1 is further described hereinafter in detail with reference to the drawings.

Figure 3:
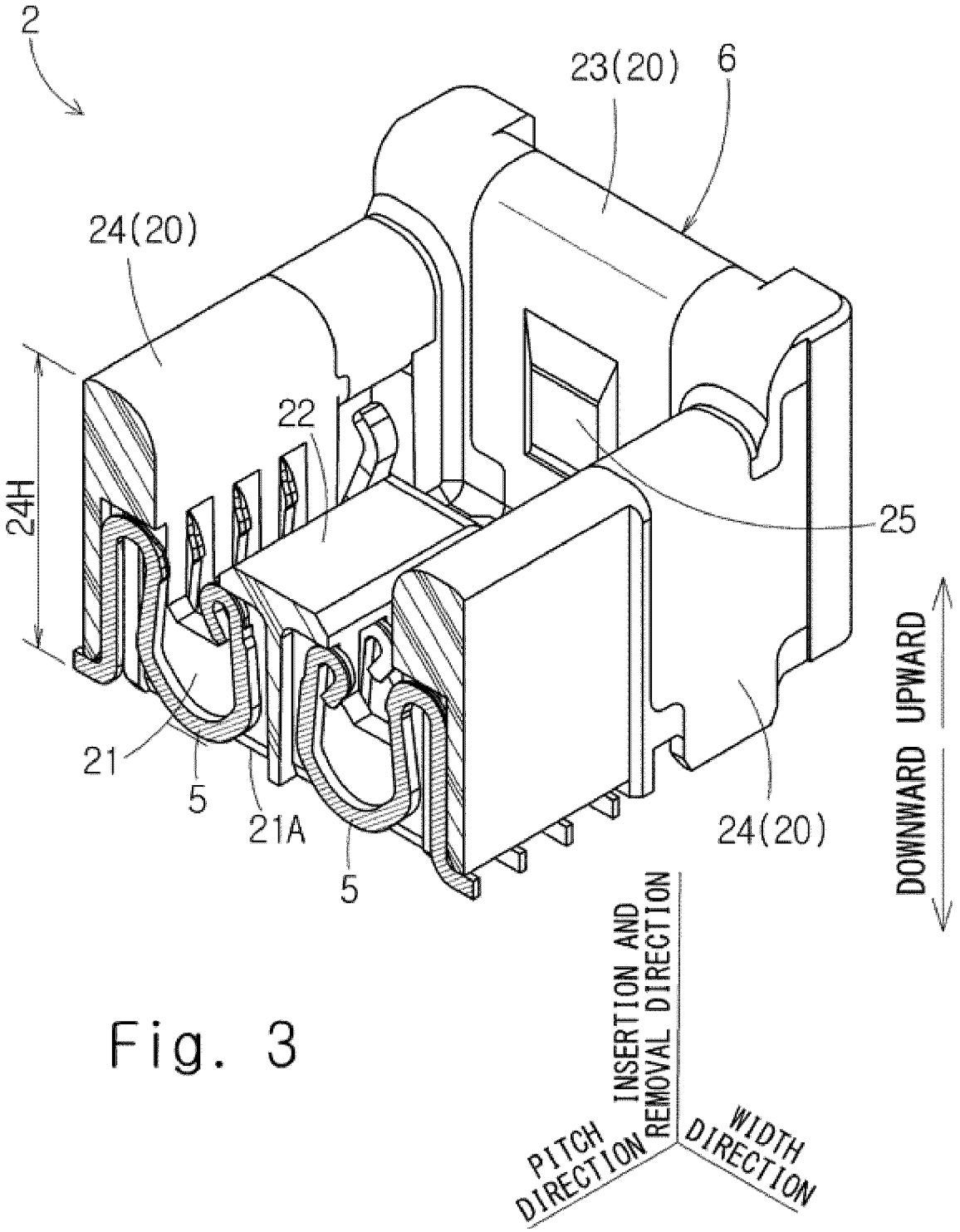
FIG. 3 is a cross-sectional perspective view of a receptacle connector divided into two halves in the pitch direction.
Figure 4:
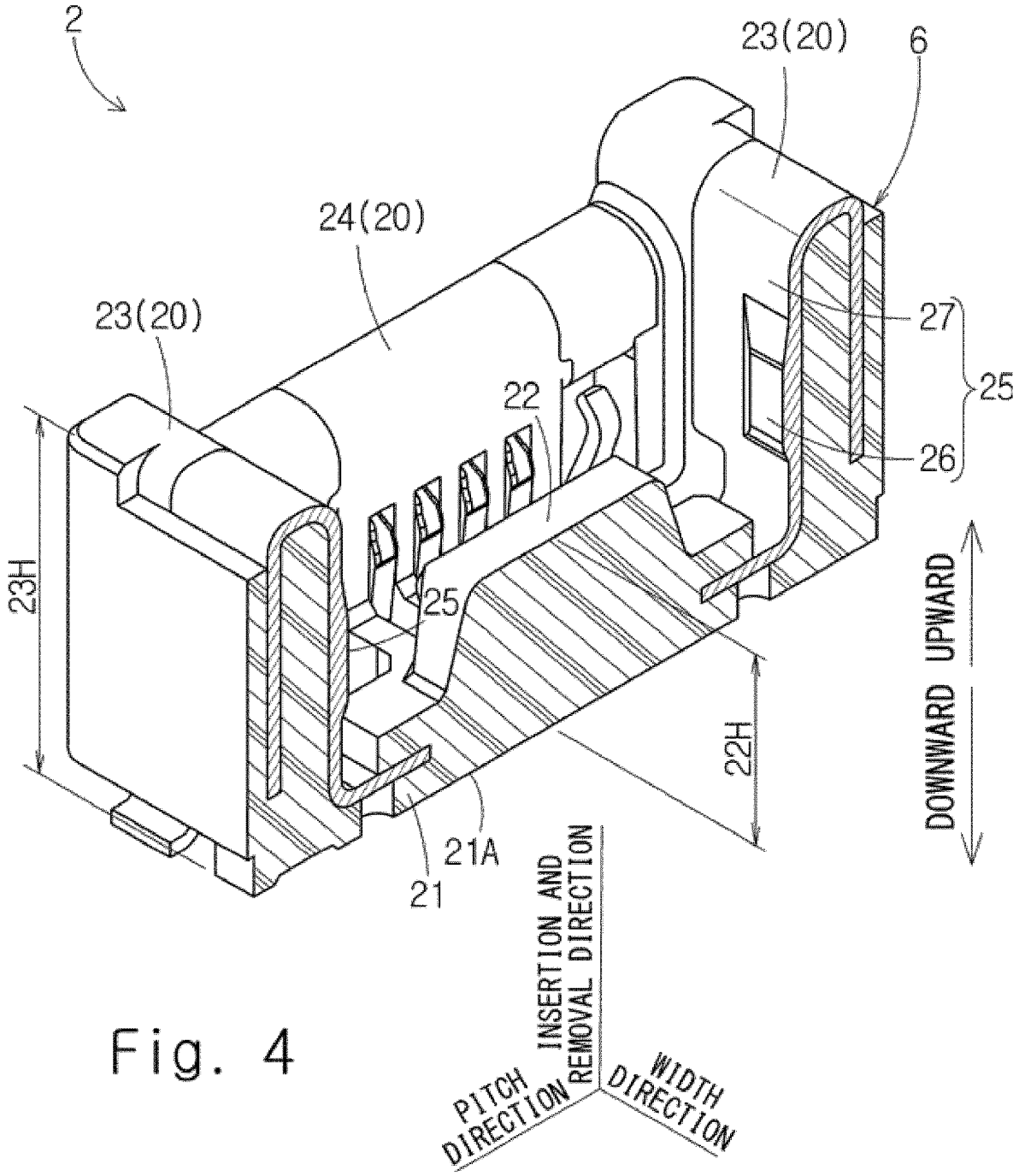
FIG. 4 is a cross-sectional perspective view of the receptacle connector divided into two halves in the width direction.
Figure 5:
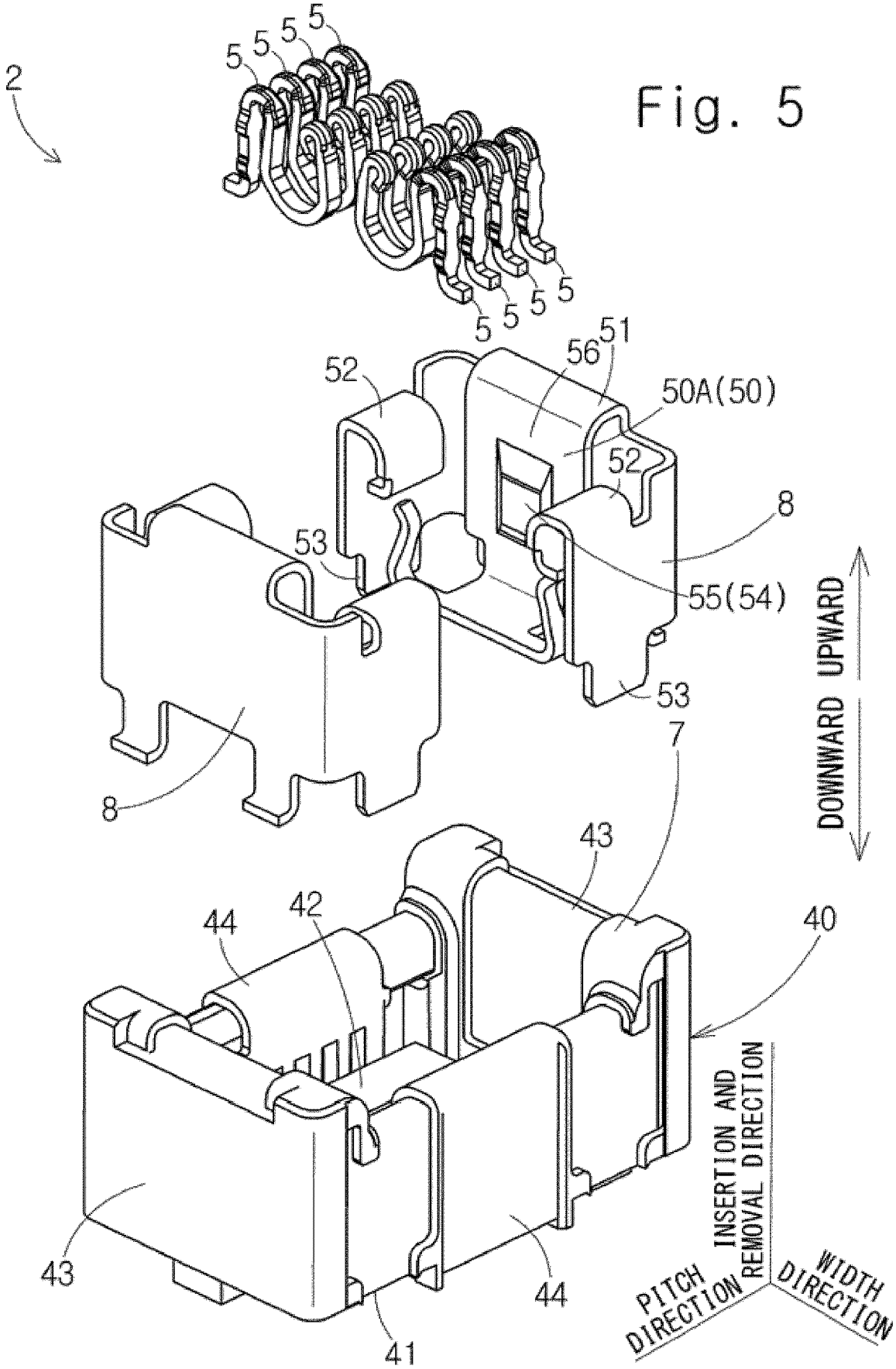
FIG. 5 is an exploded perspective view of the receptacle connector.

As shown in FIGS. 3 to 5, the shape of the receptacle connector 2 is symmetric with respect to the plane that divides the receptacle connector 2 into two halves in the pitch direction and also symmetric with respect to the plane that divides the receptacle connector 2 into two halves in the width direction. As shown in FIG. 2, the receptacle main body 6 includes the receptacle housing 7 and the two receptacle supplementary fittings 8. In the following description, instead of describing each shape of the receptacle housing 7 and the two receptacle supplementary fittings 8, the shape of the receptacle main body 6 that incorporates them is described. The receptacle housing 7 and the two receptacle supplementary fittings 8 are described at the end of this application.

As shown in FIGS. 3 and 4, the receptacle main body 6 includes a rectangular tube part 20 that extends in the insertion and removal direction so as to accommodate the plug connector 3 in the mated state where the plug connector 3 and the receptacle connector 2 are mated with each other, a bottom part 21 that closes the lower side of the rectangular tube part 20, and an island part 22 that projects upward from the bottom part 21.

The rectangular tube part 20 includes two short side walls 23 opposite each other in the pitch direction and two long side walls 24 opposite each other in the width direction. The rectangular tube part 20 projects upward from the peripheral edge of the bottom part 21.

The bottom part 21 has a bottom surface 21A opposite the connector mounting surface 4A of the receptacle side board 4.

The island part 22 is placed between the two short side walls 23, separately from the two short side walls 23. The island part 22 is placed between the two long side walls 24, separately from the two long side walls 24. Thus, the island part 22 is placed inside the rectangular tube part 20 when viewed from above, at a certain distance from the rectangular tube part 20.

In this embodiment, the two long side walls 24 are lower than the two short side walls 23. Further, the island part 22 is lower than the two long side walls 24. To be specific, as shown in FIG. 4, the height of each short side wall 23 is defined as a height 23H, and the height of the island part 22 is defined as a height 22H. Further, as shown in FIG. 3, the height of each long side wall 24 is defined as a height 24H. Each of the height 23H, the height 22H and the height 24H is the distance from the bottom surface 21A of the bottom part 21. In this embodiment, the height 23H is larger than the height 24H, and the height 24H is larger than the height 22H.

The rectangular tube part 20 has two receptacle pitch inner surfaces 25 opposite each other in the pitch direction. As shown in FIG. 4, each of the receptacle pitch inner surfaces 25 includes a first receptacle pitch inner surface 26 and a second receptacle pitch inner surface 27. The first receptacle pitch inner surface 26 and the second receptacle pitch inner surface 27 are disposed in this recited order in the removal direction and are adjacent to each other in the removal direction. Both of the first receptacle pitch inner surface 26 and the second receptacle pitch inner surface 27 are planes orthogonal to the pitch direction.

Figure 6:
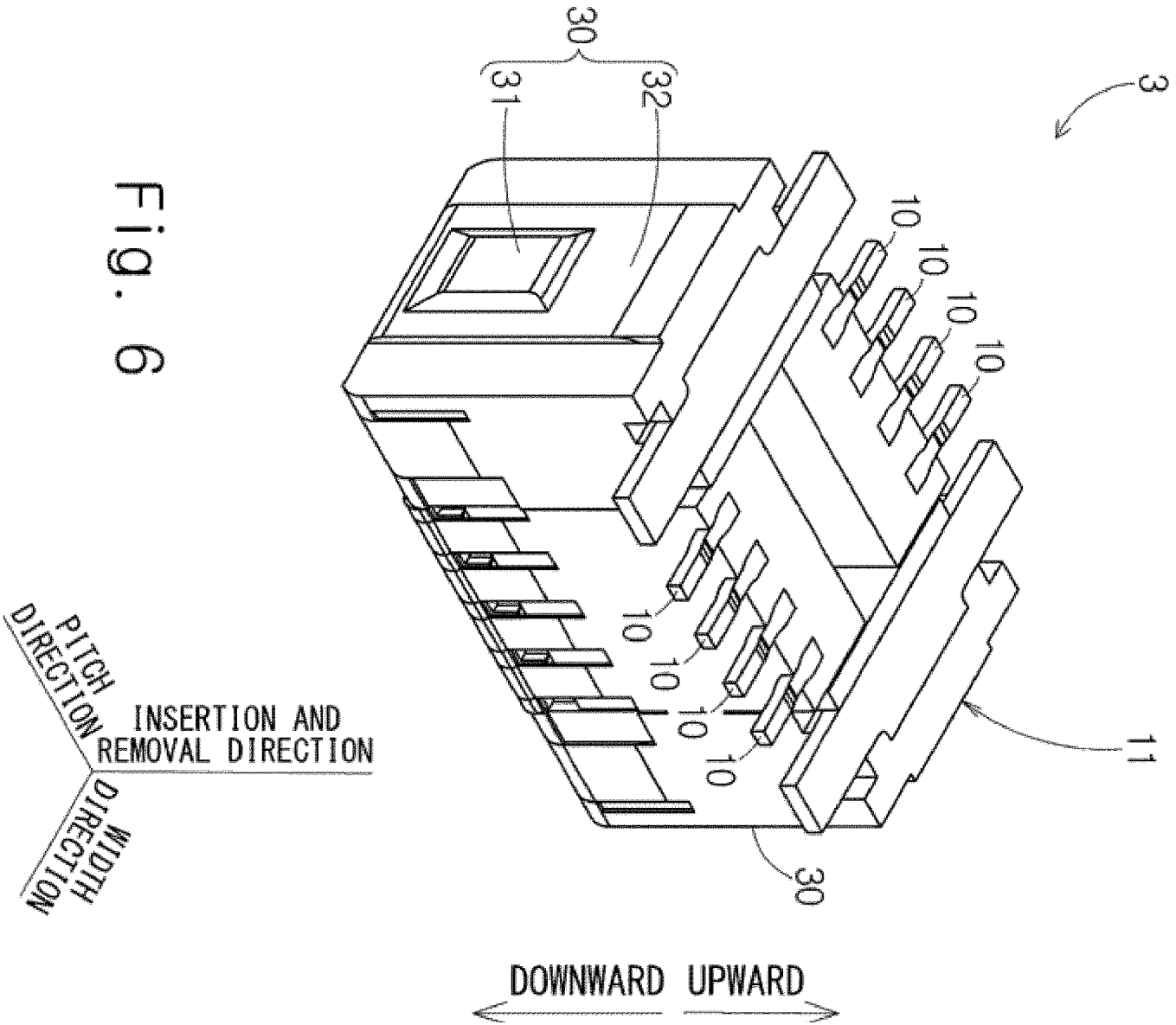
FIG. 6 is a perspective view of a plug connector.
Figure 7:
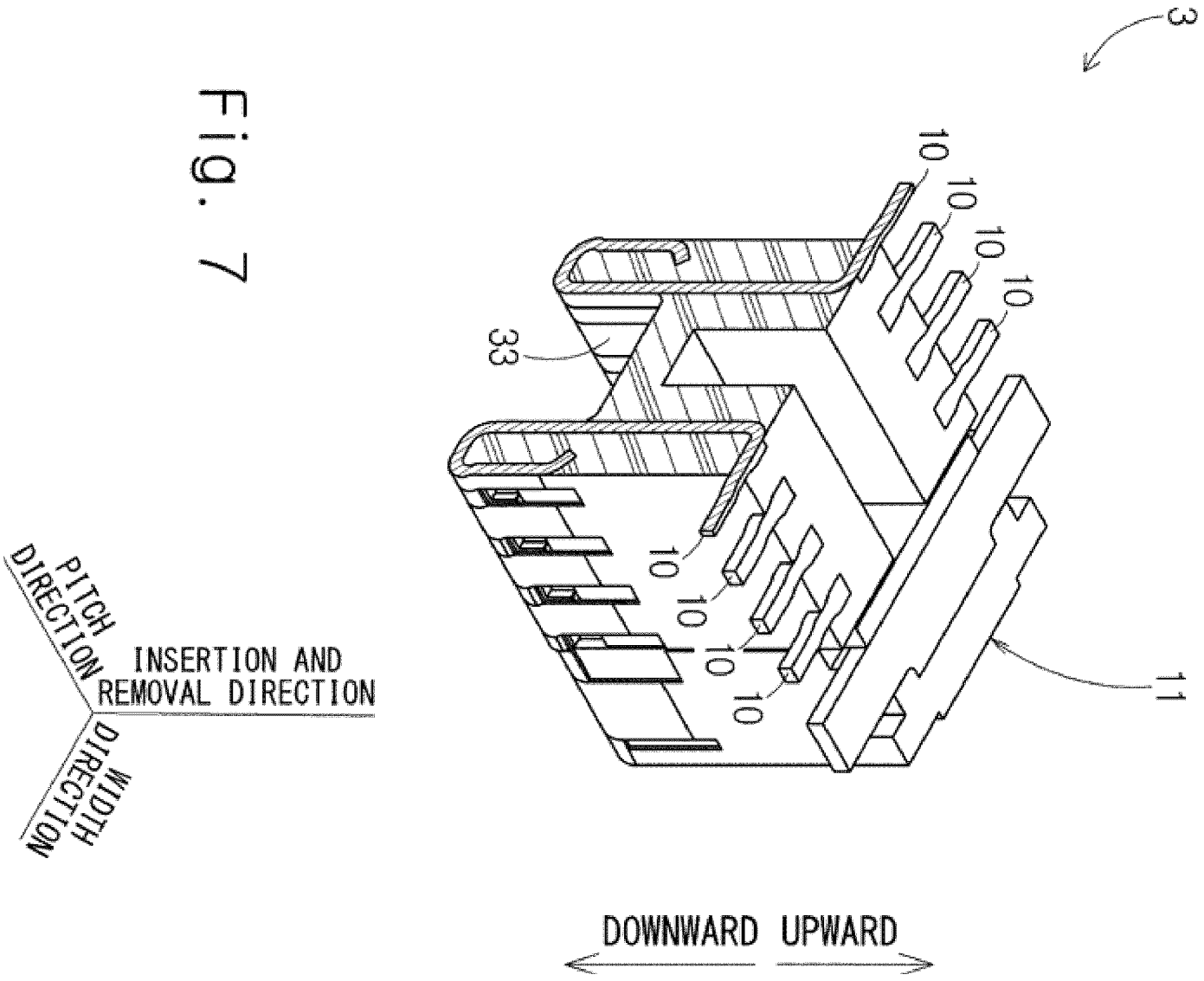
FIG. 7 is a cross-sectional perspective view of the plug connector divided into two halves in the pitch direction.
Figure 8:
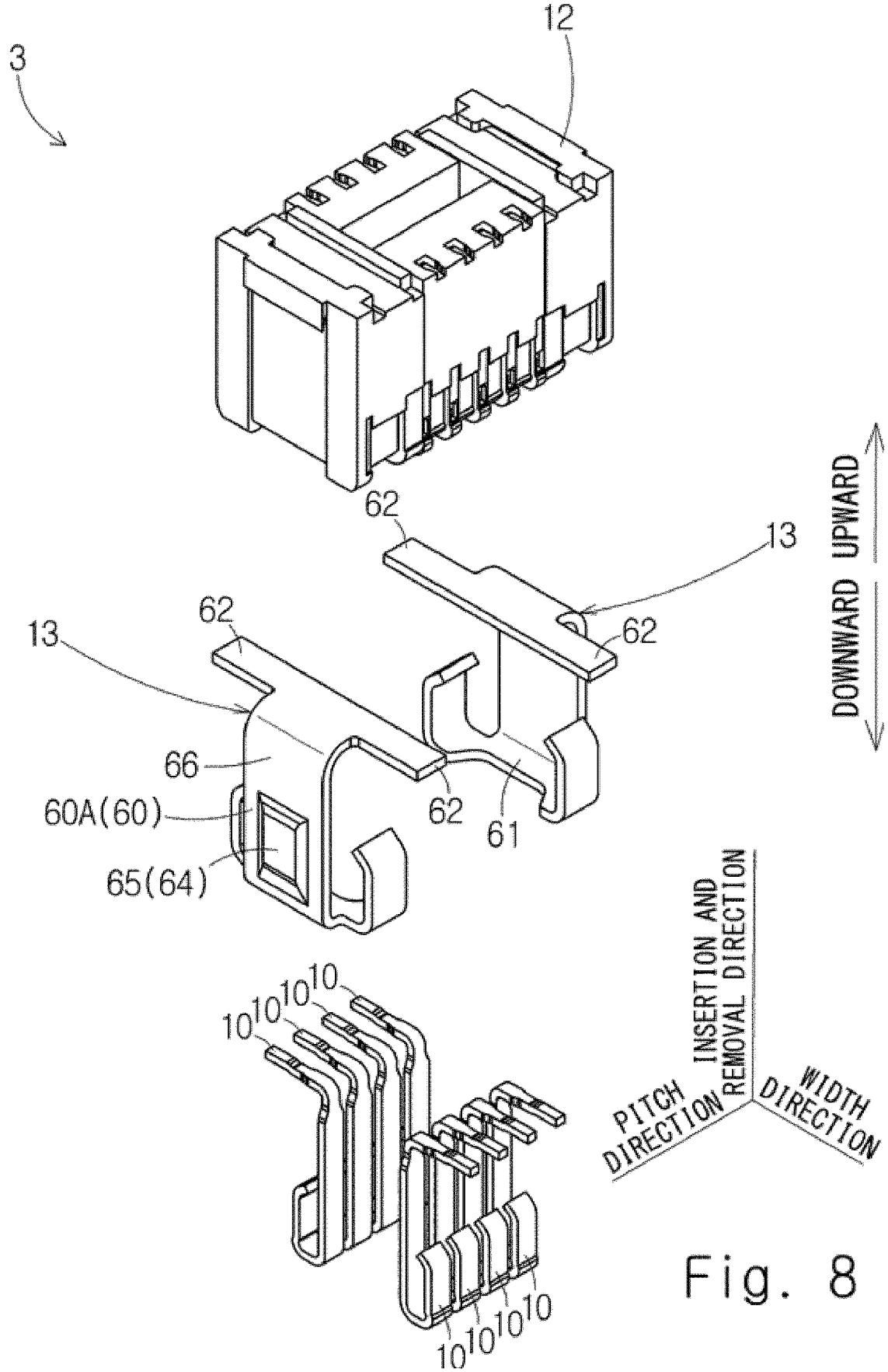
FIG. 8 is an exploded perspective view of the plug connector.

As shown in FIGS. 6 to 8, the shape of the plug connector 3 is symmetric with respect to the plane that divides the plug connector 3 into two halves in the pitch direction and also symmetric with respect to the plane that divides the plug connector 3 into two halves in the width direction. As shown in FIG. 2, the plug main body 11 includes the plug housing 12 and the two plug supplementary fittings 13. In the following description, instead of describing each shape of the plug housing 12 and the two plug supplementary fittings 13, the shape of the plug main body 11 that incorporates them is described. The plug housing 12 and the two plug supplementary fittings 13 are described at the end of this application.

As shown in FIG. 6, the plug main body 11 is substantially cuboid-shaped, and it has two plug pitch outer surfaces 30 respectively opposite the two receptacle pitch inner surfaces 25 in the pitch direction in the mated state. Each of the plug pitch outer surfaces 30 includes a first plug pitch outer surface 31 and a second plug pitch outer surface 32. The first plug pitch outer surface 31 and the second plug pitch outer surface 32 are disposed in this recited order in the removal direction and are adjacent to each other in the removal direction. The first plug pitch outer surface 31 of each of the plug pitch outer surfaces 30 is opposite the first receptacle pitch inner surface 26 of the corresponding receptacle pitch inner surface 25 in the pitch direction in the mated state. The second plug pitch outer surface 32 of each of the plug pitch outer surfaces 30 is opposite the second receptacle pitch inner surface 27 of the corresponding receptacle pitch inner surface 25 in the pitch direction in the mated state. Both of the first plug pitch outer surface 31 and the second plug pitch outer surface 32 are planes orthogonal to the pitch direction.

As shown in FIG. 7, the plug main body 11 has an island part accommodation recess 33 that accommodates the island part 22 of the receptacle connector 2 in the mated state. The island part accommodation recess 33 opens downward.

Figure 9:
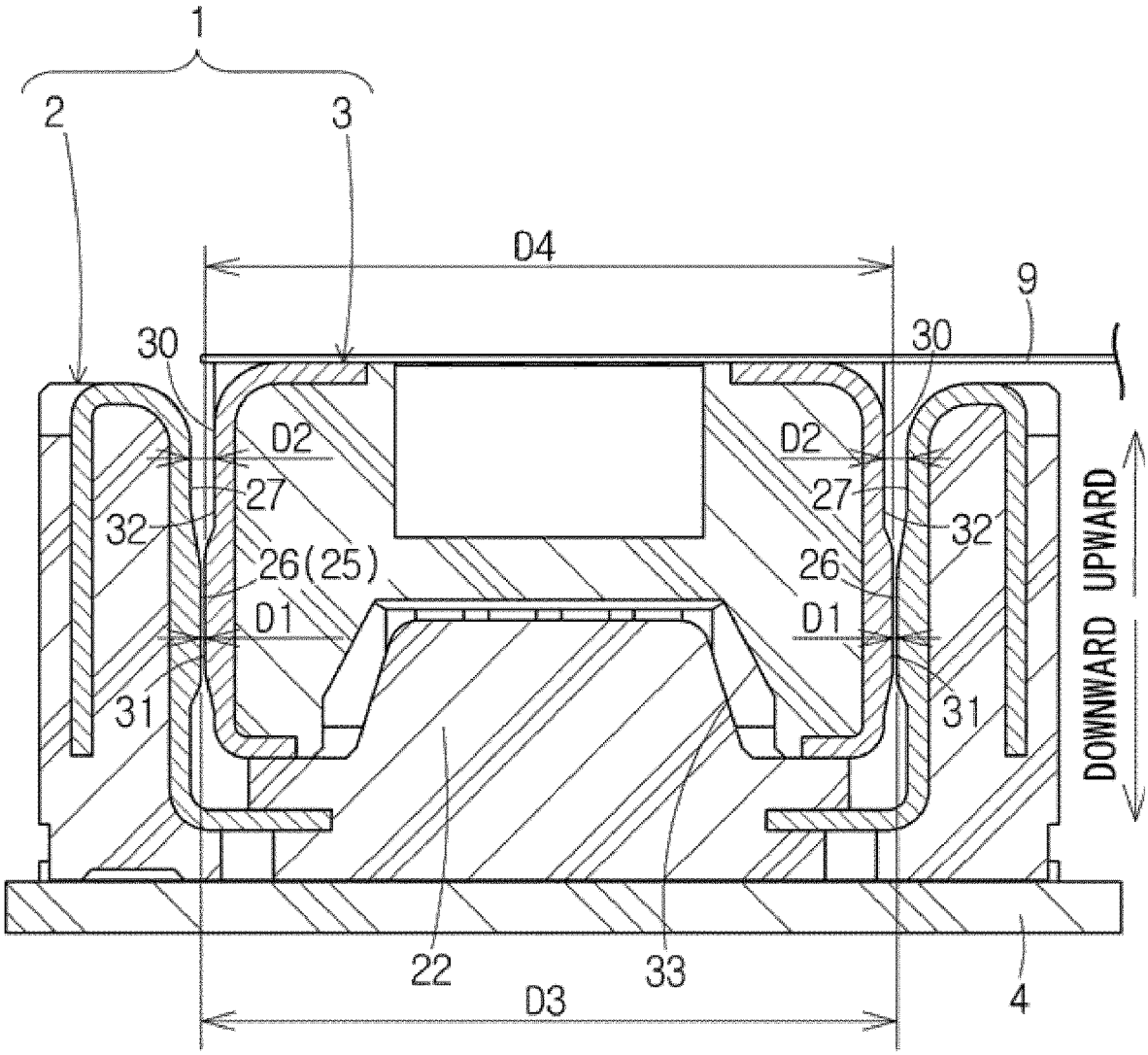
FIG. 9 is a side cross-sectional view of the plug connector mated with the receptacle connector.

FIG. 9 shows the board-to-board connector assembly 1 in the mated state. In the mated state shown in FIG. 9, the first receptacle pitch inner surface 26 of each receptacle pitch inner surface 25 and the first plug pitch outer surface 31 of the corresponding plug pitch outer surface 30 are opposite each other in the pitch direction and configured to come into surface contact with each other. Because the first receptacle pitch inner surface 26 and the first plug pitch outer surface 31 are configured to come into surface contact with each other, it is possible to reduce wear damage due to contact between the first receptacle pitch inner surface 26 and the first plug pitch outer surface 31 compared with the case where they are configured to only come into point contact with each other, for example.

Further, in the mated state shown in FIG. 9, the second receptacle pitch inner surface 27 of each receptacle pitch inner surface 25 and the second plug pitch outer surface 32 of the corresponding plug pitch outer surface 30 are opposite each other in the pitch direction and are configured not to come into contact with each other.

To be specific, when the distance of the gap in the pitch direction between the first receptacle pitch inner surface 26 and the first plug pitch outer surface 31 opposite each other in the pitch direction is a distance D1, and the distance of the gap in the pitch direction between the second receptacle pitch inner surface 27 and the second plug pitch outer surface 32 opposite each other in the pitch direction is a distance D2, the relationship of D2>D1 is established.

Further, in the mated state shown in FIG. 9, when the distance in the pitch direction between the first receptacle pitch inner surfaces 26 of the two receptacle pitch inner surfaces 25 is a distance D3, and the distance in the pitch direction between the first plug pitch outer surfaces 31 of the two plug pitch outer surfaces 30 is a distance D4, the relationship of D3>D4 is established. Therefore, in the mated state, in no case both of the two first receptacle pitch inner surfaces 26 simultaneously come into contact with the two first plug pitch outer surfaces 31. In other words, in the mated state, the plug connector 3 has a slight clearance with respect to the receptacle connector 2 in the pitch direction.

The operation of obliquely removing the plug connector 3 from the receptacle connector 2 with the plug connector 3 rotating about the axis of rotation parallel to the width direction in relation to the receptacle connector 2 is described hereinafter with reference to FIGS. 10 and 11.

First, as shown in FIG. 10, when the plug side board 9 is pulled upward as indicated by the arrow P in order to remove the plug connector 3 from the receptacle connector 2, the pull-up force and the frictional force acting between each of the plug contacts 10 and each of the receptacle contacts 5 act as a couple, and thereby the plug connector 3 rotates relative to the receptacle connector 2. At this time, the first plug pitch outer surface 31 of the lower one of the two plug pitch outer surface 30 comes into line contact with a top edge 26A of the first receptacle pitch inner surface 26 of the corresponding receptacle pitch inner surface 25, and the plug connector 3 further rotates in line contact with the top edge 26A. Specifically, in the early stage of removing the plug connector 3 from the receptacle connector 2, the center of rotation of the plug connector 3 is at the top edge 26A. Because the center of rotation is closer to the receptacle side board 4 compared with a conventional product where the center of rotation of the plug connector 3 is a top end, the plug connector 3 is allowed to rotate largely with respect to the receptacle connector 2 while being accommodated in the receptacle connector 2. This enables easy removal of the plug connector 3 from the receptacle connector 2.

Figure 11:
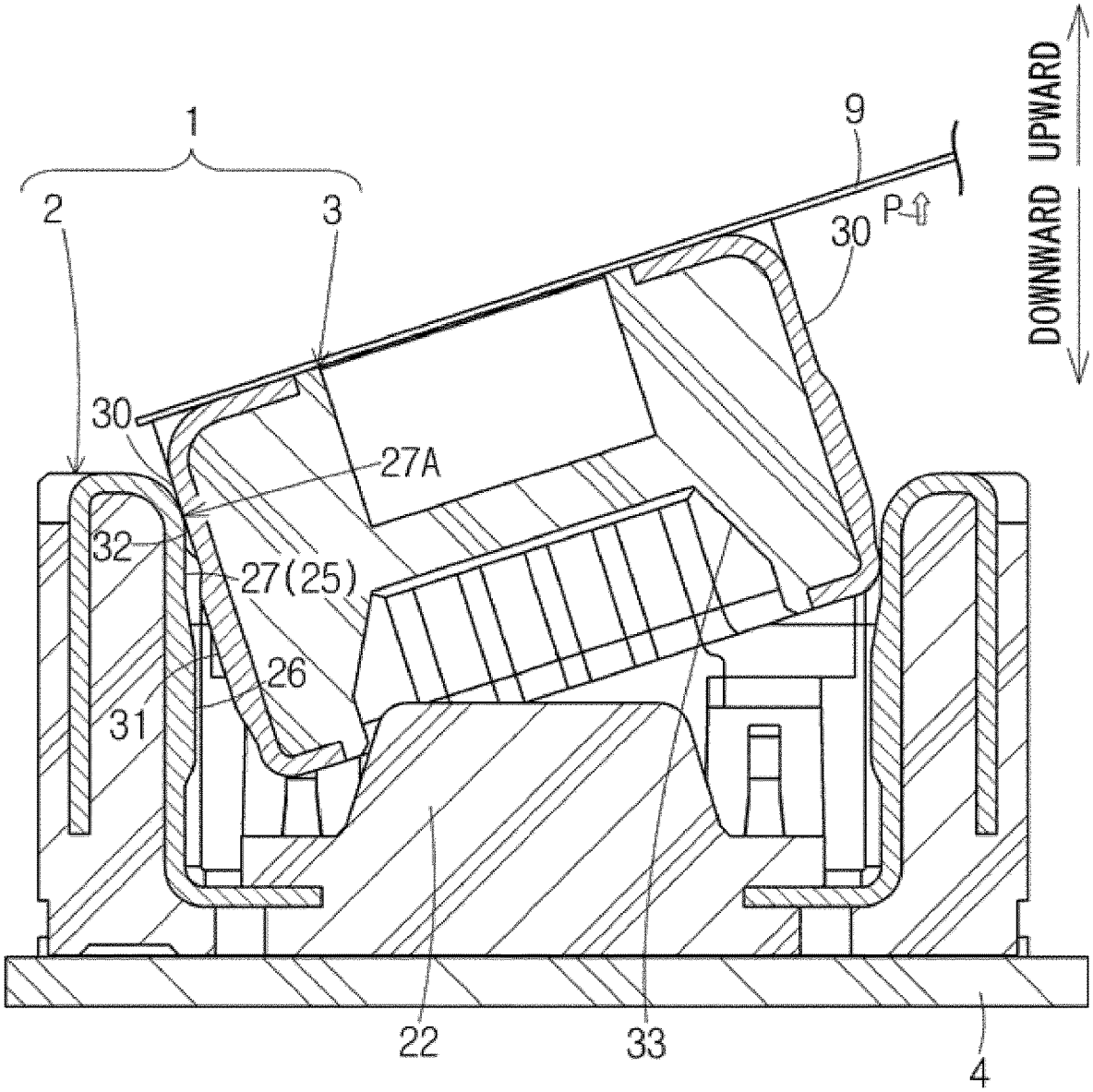
FIG. 11 is a side cross-sectional view showing an intermediate stage of obliquely removing the plug connector from the receptacle connector.
Figure 12:
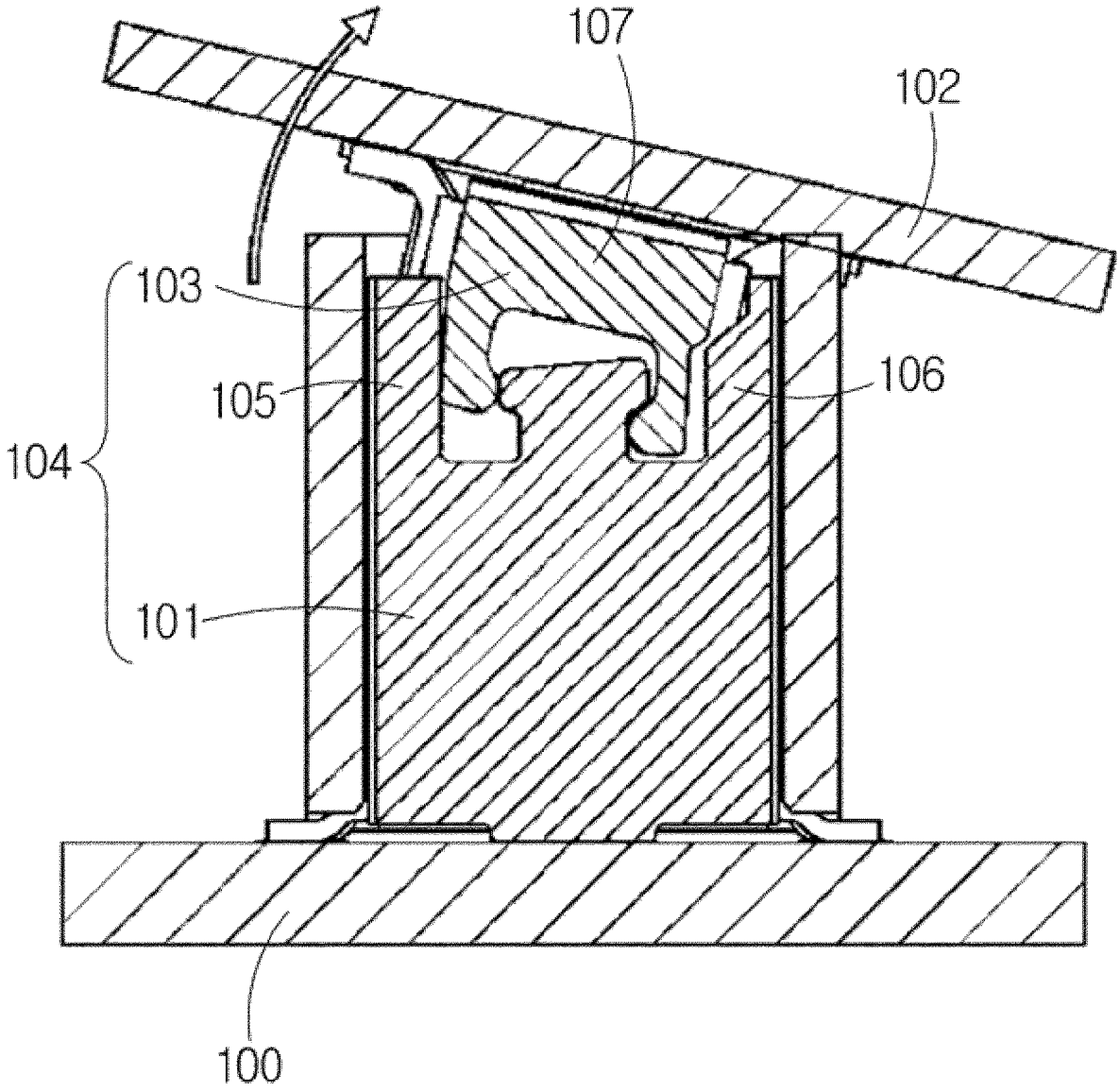
Fig. 12 (PRIOR ART)
FIG. 12 is a view showing a simplified version of FIG. 7 of Japanese Unexamined Patent Application Publication No. 2019-133798.

Then, as shown in FIG. 11, when the plug side board 9 is pulled further upward as indicated by the arrow P in order to remove the plug connector 3 from the receptacle connector 2, the plug connector 3 further rotates relative to the receptacle connector 2 by physical interference between the plug connector 3 and the receptacle connector 2. At this time, the second plug pitch outer surface 32 of the lower one of the two plug pitch outer surface 30 comes into line contact with a top edge 27A of the second receptacle pitch inner surface 27 of the corresponding receptacle pitch inner surface 25, and the plug connector 3 further rotates in line contact with the top edge 27A. Thus, in the intermediate stage of removing the plug connector 3 from the receptacle connector 2, the center of rotation of the plug connector 3 is at the top edge 27A.

The embodiment of the present disclosure is described above. The above-described embodiment has the following features.

As shown in FIGS. 1 and 2, the board-to-board connector assembly 1 (connector assembly) includes the receptacle connector 2 and the plug connector 3. The plug connector 3 includes the plurality of plug contacts 10 and the plug main body 11 that accommodates the plurality of plug contacts 10, and is configured to be mountable on the plug side board 9. The receptacle connector 2 includes the plurality of receptacle contacts 5 and the receptacle main body 6 that accommodates the plurality of receptacle contacts 5, and is configured to be mountable on the receptacle side board 4.

By mating the plug connector 3 and the receptacle connector 2 with each other, the plurality of plug contacts 10 and the plurality of receptacle contacts 5 are respectively brought into electrical contact with each other.

As shown in FIG. 4, the receptacle main body 6 includes the rectangular tube part 20 that accommodates the plug connector 3 in the mated state where the plug connector 3 and the receptacle connector 2 are mated with each other. The rectangular tube part 20 has the two receptacle pitch inner surfaces 25 opposite each other in the pitch direction. As shown in FIG. 6, the plug main body 11 has the two plug pitch outer surfaces 30 respectively opposite the two receptacle pitch inner surfaces 25 in the pitch direction in the mated state. As shown in FIG. 4, each of the receptacle pitch inner surfaces 25 includes the first receptacle pitch inner surface 26 and the second receptacle pitch inner surface 27 in this recited order in the removal direction of removing the plug connector 3 from the receptacle connector 2. As shown in FIG. 6, each of the plug pitch outer surfaces 30 includes the first plug pitch outer surface 31 opposite the first receptacle pitch inner surface 26 in the pitch direction in the mated state and the second plug pitch outer surface 32 opposite the second receptacle pitch inner surface 27 in the pitch direction in the mated state in this recited order in the removal direction.

As shown in FIG. 9, the first receptacle pitch inner surface 26 and the first plug pitch outer surface 31 opposite each other are both flat surfaces, and they are configured to come into surface contact with each other in the mated state. This structure prevents damage due to mutual contact between the first receptacle pitch inner surface 26 and the first plug pitch outer surface 31 compared with the case where the first receptacle pitch inner surface 26 and the first plug pitch outer surface 31 come into point contact with each other.

As shown in FIG. 9, the distance D2 in the pitch direction between the second receptacle pitch inner surface 27 and the second plug pitch outer surface 32 opposite each other in the mated state is larger than the distance D1 in the pitch direction between the first receptacle pitch inner surface 26 and the first plug pitch outer surface 31 opposite each other in the mated state. In this structure, the center of rotation of the plug connector 3 is closer to the receptacle side board 4 in the early stage of oblique removal, and it is thereby possible to achieve both the high-profile board-to-board connector assembly 1 and oblique removal.

As shown in FIG. 9, the distance D3 (dimension) in the pitch direction between the first receptacle pitch inner surfaces 26 of the two receptacle pitch inner surfaces 25 is longer (larger) than the distance D4 (dimension) in the pitch direction between the first plug pitch outer surfaces 31 of the two plug pitch outer surfaces 30. In this structure, in the mated state, the plug connector 3 has a slight clearance with respect to the receptacle connector 2 in the pitch direction. This clearance in the pitch direction provides a space for the plug connector 3 to rotate when obliquely removing the plug connector 3 from the receptacle connector 2.

Further, the shape of the receptacle connector 2 is symmetric with respect to the plane that divides the receptacle connector 2 into two halves in the pitch direction. The shape of the plug connector 3 is also symmetric with respect to the plane that divides the plug connector 3 into two halves in the pitch direction. Thus, in oblique removal that removes the plug connector 3 from the receptacle connector 2 with the plug connector 3 rotating about the axis of rotation parallel to the width direction in relation to the receptacle connector 2, the direction of rotation is not restricted, which achieves good handleability in the removal operation of the board-to-board connector assembly 1.

Further, as shown in FIGS. 3 and 4, the rectangular tube part 20 has the two short side walls 23 opposite each other in the pitch direction and the two long side walls 24 opposite each other in the width direction. The two long side walls 24 are lower than the two short side walls 23. This structure reduces physical interference between the plug connector 3 and the receptacle connector 2 when obliquely removing the plug connector 3 from the receptacle connector 2 with the plug connector 3 rotating about the axis of rotation parallel to the pitch direction in relation to the receptacle connector 2.

Further, as shown in FIGS. 3 and 4, the receptacle main body 6 includes the island part 22 that projects in the removal direction. As shown in FIG. 7, the plug main body 11 has the island part accommodation recess 33 that accommodates the island part 22 in the mated state. As shown in FIGS. 3 and 4, the island part 22 is lower than the two long side walls 24. This structure reduces physical interference between the island part 22 of the receptacle connector 2 and the plug connector 3 when obliquely removing the plug connector 3 from the receptacle connector 2 with the plug connector 3 rotating about the axis of rotation parallel to the pitch direction or the width direction in relation to the receptacle connector 2.

The structures of the receptacle connector 2 and the plug connector 3 are described in further detail hereinafter with reference to FIGS. 5 and 8.

As shown in FIG. 5, the receptacle housing 7 includes a housing rectangular tube part 40 that is equivalent of the rectangular tube part 20, a housing bottom part 41 that is equivalent of the bottom part 21, and a housing island part 42 that is equivalent of the island part 22.

The housing rectangular tube part 40 has two housing short side walls 43 that are respectively equivalent of the two short side walls 23, and two housing long side walls 44 that are respectively equivalent of the two long side walls 24. The housing rectangular tube part 40 projects upward from the peripheral edge of the housing bottom part 41.

Each of the receptacle supplementary fittings 8 includes a short side wall cover part 50 to be placed internally in the pitch direction to the corresponding housing short side wall 43, a short side wall protection part 51 to cover the top edge of the corresponding housing short side wall 43, two long side wall protection parts 52 to respectively cover the top edges of the two housing long side walls 44, and two soldered leg parts 53 to be soldered onto the receptacle side board 4.

A short side wall cover part inner surface 50A facing inward in the pitch direction of the short side wall cover part 50 is equivalent of the above-described receptacle pitch inner surface 25. The short side wall cover part inner surface 50A has a receptacle projecting part 54 that projects inward in the pitch direction. The receptacle projecting part 54 has a truncated quadrangular pyramid shape. A truncated surface 55 of the receptacle projecting part 54 is equivalent of the above-described first receptacle pitch inner surface 26. An upper part 56 of the receptacle projecting part 54 in the short side wall cover part inner surface 50A is equivalent of the above-described second receptacle pitch inner surface 27.

As shown in FIG. 8, the plug housing 12 is substantially cuboid-shaped.

Each of the plug supplementary fittings 13 includes a short side surface cover part 60 to be placed outwardly in the pitch direction to the plug housing 12, a short side surface protection part 61 to be placed below the plug housing 12, and two soldered leg parts 62 to be soldered onto the plug side board 9.

A short side surface cover part outer surface 60A facing outward in the pitch direction of the short side surface cover part 60 is equivalent of the above-described plug pitch outer surface 30. The short side surface cover part outer surface 60A has a plug projecting part 64 that projects outward in the pitch direction. The plug projecting part 64 has a truncated quadrangular pyramid shape. A truncated surface 65 of the plug projecting part 64 is equivalent of the above-described first plug pitch outer surface 31. An upper part 66 of the plug projecting part 64 in the short side surface cover part outer surface 60A is equivalent of the above-described second plug pitch outer surface 32.

The structures described above are summarized as follows.

As shown in FIGS. 3 to 5, the receptacle projecting part 54 that projects in the pitch direction is formed on at least one of the two receptacle pitch inner surfaces 25 (the short side wall cover part inner surfaces 50A). The first receptacle pitch inner surface 26 (the truncated surface 55) is formed on the receptacle projecting part 54. Note that, in this embodiment, the receptacle projecting part 54 is formed on both of the two receptacle pitch inner surfaces 25 (the short side wall cover part inner surfaces 50A).

Note that, however, the shape of the receptacle projecting part 54 is not limited to the shape described in this embodiment as long as the distance D1 of the gap in the pitch direction between the first receptacle pitch inner surface 26 and the first plug pitch outer surface 31 opposite each other in the pitch direction and the distance D2 of the gap in the pitch direction between the second receptacle pitch inner surface 27 and the second plug pitch outer surface 32 opposite each other in the pitch direction satisfy the relationship of D2>D1, and the distance D3 in the pitch direction between the first receptacle pitch inner surfaces 26 of the two receptacle pitch inner surfaces 25 and the distance D4 in the pitch direction between the first plug pitch outer surfaces 31 of the two plug pitch outer surfaces 30 satisfy the relationship of D3>D4.

Further, the receptacle main body 6 includes the receptacle housing 7 that is made of resin and holds the plurality of receptacle contacts 5, and the two receptacle supplementary fittings 8 that are attached to the receptacle housing 7. Each of the receptacle supplementary fittings 8 has each of the receptacle pitch inner surfaces 25. Alternatively, the receptacle main body 6 may include only one receptacle supplementary fitting 8, or may include no receptacle supplementary fitting 8, or the receptacle housing 7 may have the receptacle pitch inner surfaces 25. Further, when the receptacle main body 6 includes only one receptacle supplementary fitting 8, the receptacle supplementary fitting 8 may have two receptacle pitch inner surfaces 25. For example, two receptacle supplementary fittings 8 may be coupled with each other.

Further, as shown in FIGS. 6 to 8, the plug projecting part 64 that projects in the pitch direction is formed on at least one of the two plug pitch outer surfaces 30 (the short side surface cover part outer surfaces 60A). The first plug pitch outer surface 31 (the truncated surface 65) is formed on the plug projecting part 64. Note that, in this embodiment, the plug projecting part 64 is formed on both of the two plug pitch outer surfaces 30 (the short side surface cover part outer surfaces 60A).

Note that, however, the shape of the plug projecting part 64 is not limited to the shape described in this embodiment as long as the distance D1 of the gap in the pitch direction between the first receptacle pitch inner surface 26 and the first plug pitch outer surface 31 opposite each other in the pitch direction and the distance D2 of the gap in the pitch direction between the second receptacle pitch inner surface 27 and the second plug pitch outer surface 32 opposite each other in the pitch direction satisfy the relationship of D2>D1, and the distance D3 in the pitch direction between the first receptacle pitch inner surfaces 26 of the two receptacle pitch inner surfaces 25 and the distance D4 in the pitch direction between the first plug pitch outer surfaces 31 of the two plug pitch outer surfaces 30 satisfy the relationship of D3>D4.

Further, the plug main body 11 includes the plug housing 12 that is made of resin and holds the plurality of plug contacts 10, and the two plug supplementary fittings 13 that are attached to the plug housing 12. Each of the plug supplementary fittings 13 has each of the plug pitch outer surfaces 30. Alternatively, the plug main body 11 may include only one plug supplementary fitting 13, or may include no plug supplementary fitting 13, or the plug housing 12 may have the plug pitch outer surfaces 30. Further, when the plug main body 11 includes only one plug supplementary fitting 13, the plug supplementary fitting 13 may have two plug pitch outer surfaces 30. For example, two plug supplementary fittings 13 may be coupled with each other.

Furthermore, any one of the receptacle projecting part 54 and the plug projecting part 64 may be omitted as long as the distance D1 of the gap in the pitch direction between the first receptacle pitch inner surface 26 and the first plug pitch outer surface 31 opposite each other in the pitch direction and the distance D2 of the gap in the pitch direction between the second receptacle pitch inner surface 27 and the second plug pitch outer surface 32 opposite each other in the pitch direction satisfy the relationship of D2>D1, and the distance D3 in the pitch direction between the first receptacle pitch inner surfaces 26 of the two receptacle pitch inner surfaces 25 and the distance D4 in the pitch direction between the first plug pitch outer surfaces 31 of the two plug pitch outer surfaces 30 satisfy the relationship of D3>D4.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A connector assembly comprising:

a plug connector including a plurality of plug contacts, and a plug main body that accommodates the plurality of plug contacts, the plug connector being mountable on a plug side board; and a receptacle connector including a plurality of receptacle contacts, and a receptacle main body that accommodates the plurality of receptacle contacts, the receptacle connector being mountable on a receptacle side board, wherein the plurality of plug contacts and the plurality of receptacle contacts are respectively brought into electrical contact with each other by mating the plug connector and the receptacle connector with each other, the receptacle main body includes a rectangular tube part that accommodates the plug connector in a mated state where the plug connector and the receptacle connector are mated with each other, the rectangular tube part has two receptacle pitch inner surfaces opposite each other in a pitch direction along which the plurality of receptacle contacts are aligned, the plug main body has two plug pitch outer surfaces respectively opposite the two receptacle pitch inner surfaces in the pitch direction in the mated state, each of the receptacle pitch inner surfaces includes a first receptacle pitch inner surface and a second receptacle pitch inner surface in this recited order in a removal direction of removing the plug connector from the receptacle connector, each of the plug pitch outer surfaces includes a first plug pitch outer surface opposite the first receptacle pitch inner surface in the pitch direction in the mated state and a second plug pitch outer surface opposite the second receptacle pitch inner surface in the pitch direction in the mated state in this recited order in the removal direction, the first receptacle pitch inner surface and the first plug pitch outer surface opposite each other are both flat surfaces and configured to come into surface contact with each other in the mated state, a distance in the pitch direction between the second receptacle pitch inner surface and the second plug pitch outer surface opposite each other in the mated state is larger than a distance in the pitch direction between the first receptacle pitch inner surface and the first plug pitch outer surface opposite each other in the mated state, and a dimension in the pitch direction between the first receptacle pitch inner surfaces of the two receptacle pitch inner surfaces is larger than a dimension in the pitch direction between the first plug pitch outer surfaces of the two plug pitch outer surfaces.

2. The connector assembly according to claim 1, wherein a receptacle projecting part that projects in the pitch direction is formed on at least one of the two receptacle pitch inner surfaces, and the first receptacle pitch inner surface is formed on the receptacle projecting part.

3. The connector assembly according to claim 1, wherein a plug projecting part that projects in the pitch direction is formed on at least one of the two plug pitch outer surfaces, and the first plug pitch outer surface is formed on the plug projecting part.

4. The connector assembly according to claim 1, wherein the receptacle main body includes a receptacle housing that is made of resin and holds the plurality of receptacle contacts, and a receptacle supplementary fitting that is attached to the receptacle housing, and the receptacle supplementary fitting has at least one of the two receptacle pitch inner surfaces.

5. The connector assembly according to claim 1, wherein the plug main body includes a plug housing that is made of resin and holds the plurality of plug contacts, and a plug supplementary fitting that is attached to the plug housing, and the plug supplementary fitting has at least one of the two plug pitch outer surfaces.

6. The connector assembly according to claim 1, wherein the rectangular tube part has two short side walls opposite each other in the pitch direction and two long side walls opposite each other in a direction orthogonal to the pitch direction, and the two long side walls are lower than the two short side walls.

7. The connector assembly according to claim 6, wherein the receptacle main body includes an island part that projects in the removal direction, the plug main body has an island part accommodation recess that accommodates the island part in the mated state, and the island part is lower than the two long side walls.

* * * * *